US011000751B1

(12) United States Patent
Baillie

(10) Patent No.: US 11,000,751 B1
(45) Date of Patent: May 11, 2021

(54) GAME BALL LOCATING SYSTEM

(71) Applicant: Earle Eugene Baillie, Anderson, SC (US)

(72) Inventor: Earle Eugene Baillie, Anderson, SC (US)

( * ) Notice: Subject to any disclaimer, the term of this patent is extended or adjusted under 35 U.S.C. 154(b) by 0 days.

(21) Appl. No.: 16/750,268

(22) Filed: Jan. 23, 2020

Related U.S. Application Data

(63) Continuation-in-part of application No. 15/713,668, filed on Sep. 24, 2017, now abandoned.

(60) Provisional application No. 62/421,808, filed on Nov. 14, 2016.

(51) Int. Cl.
*A63B 71/06* (2006.01)
*A63B 43/00* (2006.01)
*A63B 24/00* (2006.01)

(52) U.S. Cl.
CPC ..... *A63B 71/0605* (2013.01); *A63B 24/0021* (2013.01); *A63B 43/004* (2013.01); *A63B 2024/0034* (2013.01); *A63B 2024/0053* (2013.01); *A63B 2220/44* (2013.01); *A63B 2220/56* (2013.01); *A63B 2220/803* (2013.01); *A63B 2220/833* (2013.01); *A63B 2225/20* (2013.01); *A63B 2225/50* (2013.01); *A63B 2243/007* (2013.01)

(58) Field of Classification Search
CPC ..... A63B 71/0605; A63B 24/0221; A63B 43/004; A63B 2024/0053
USPC ..... 473/467
See application file for complete search history.

(56) References Cited

U.S. PATENT DOCUMENTS 6,122,960 A * 9/2000 Hutchings ..... A63B 24/00 73/493
2003/0054905 A1* 3/2003 King, Jr. ..... A63B 24/0021 473/467
2006/0154758 A1* 7/2006 Laliberty ..... A63B 41/12 473/593
2019/0036360 A1* 1/2019 Zilles ..... A63B 71/0669

FOREIGN PATENT DOCUMENTS

DE 102016000694 B4 * 1/2016 ..... A63B 57/20

* cited by examiner

*Primary Examiner* — John E Simms, Jr.
*Assistant Examiner* — Rayshun K Peng
(74) *Attorney, Agent, or Firm* — Kenneth L. Tolar

(57) ABSTRACT

A game ball locating system includes a ball with in internal MEMS module that communicates with transceivers positioned about the periphery of a playing field. A wireless radio frequency barrier is positioned below the playing field boundary, i.e., the sidelines and goal lines. The MEMS module includes a gyrometer and accelerometer that determine when the base ceases motion. The MEMS further measures signal strength emanating from the radio frequency barrier to determine when the ball crosses the playing field boundary. In either event, a controlling computer activates the transceivers, which transmit a signal to the MEMS module and the computer calculates the exact position of the ball.

10 Claims, 10 Drawing Sheets

GAME BALL LOCATING SYSTEM

CROSS REFERENCE TO RELATED APPLICATIONS

This application is a continuation-in-part of application Ser. No. 15/713,668, which claimed priority of provisional application No. 62/421,808 filed on Nov. 14, 2016, the specifications of which are incorporated herein by reference.

BACKGROUND OF THE INVENTION

The present invention relates to a system for precisely locating a position of a game ball when stopped or crossing a playing field boundary.

DESCRIPTION OF THE PRIOR ART

Properly spotting a football after a given play is often extremely difficult and subjective. A referee's view of a tackled player is often obstructed by participating players so that accurately spotting the ball for the next play can be challenging. Improperly placing a ball by an inch can cost a team a touchdown or a first down, resulting in a lost possession.

Determining where a ball crosses a sideline during a punt or when a ball carrier is forced out of bounds is equally subjective. A referee is usually down the field from the ball or is otherwise in a poor position to accurately determine the ball's position relative to the sideline. The referee must typically estimate the ball's location which results in inaccurate placements that can cost a team possession or even the game.

Determining where a ball stops relative to the goal line or a first down marker is equally difficult due to player obstruction. Often, the placement of the ball determines the outcome of games and inaccurate spots can cost teams games or championships.

Many leagues have implemented replay reviews in order to address this problem. However, a limited number of cameras are used and their viewing angles are often limited. Therefore, even after a replay review, the ball is often misplaced.

Accordingly, there is currently a need for a system for accurately locating a game ball when crossing a given playing field boundary or becoming motionless. The present invention addresses this need by providing a game ball with an integral micro-electromechanical system (MEMS) module that interacts with a wireless transmitting barrier defining a playing field boundary and peripheral transceivers. The MEMS module communicates with a high-speed controlling computer that calculates an exact location of the ball whenever it crosses the barrier or stops moving.

SUMMARY OF THE INVENTION

The present invention relates to a game ball locating system for precisely locating a position of a game ball when stopped or crossing a playing field boundary. The ball includes a micro-electromechanical system (MEMS) module that communicates with transceivers to determine the ball's location under certain conditions. The system also includes a wireless barrier that includes an RF transmitter connected to a continuous cable immediately beneath the two sidelines and the two goal lines. The MEMS module continuously measures the signal strength of the transmitting barrier until the strength reaches its peak, which indicates the ball is immediately above the playing field boundary.

The system further includes a plurality of time-of-flight (TOF) transceivers that transmit a wireless signal when receiving a predetermined command from a controlling computer. A controlling computer engages the TOF transceivers to transmit a discrete signal to the MEMS module in order for the computer algorithms to calculate the ball's location on the playing field. Accordingly, as the game ball approaches the sideline or goal line, the measured signal strength of the transmitting barrier gradually increases until reaching a peak level before decreasing. When the MEMS module determines that peak strength of the wireless barrier has been reached, it requests a location determination. The controlling computer then activates the TOF transmitters to transmit a signal to the MEMS module and the computer calculates the exact position of the ball when the signal strength peaked. Likewise, if the ball stops moving, the MEMS module notifies the computer to instruct the transceivers to transmit location signals to the football.

It is therefore an object of the present invention to provide a system for precisely locating a position of a game ball when stopped or crossing a playing-field boundary.

It is therefore another object of the present invention to provide a game ball locating system that adjusts a precise location of a game ball according to ball orientation.

It is yet another object of the present invention to provide a game ball locating system that audibly communicates a ball's location to a referee for immediate placement.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
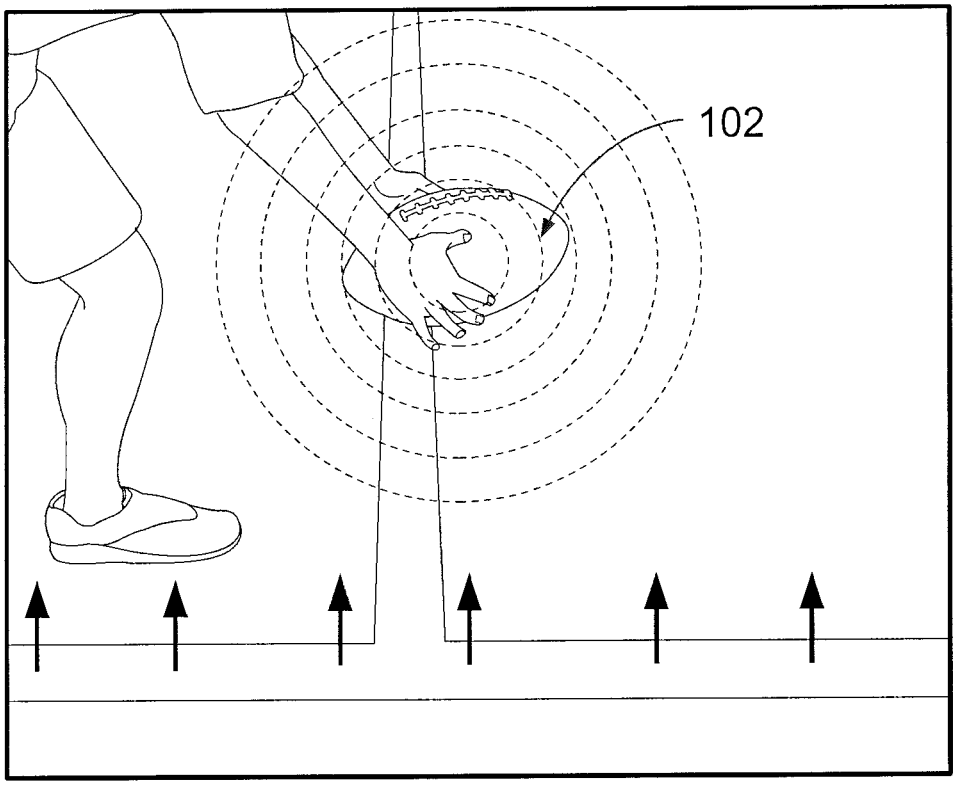
FIG. 1 depicts the ball according to the present invention crossing the transmitting barrier.
Figure 2:
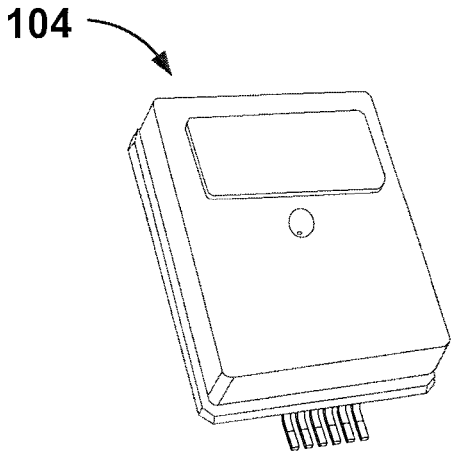
FIG. 2 is an isolated view of the MEMS module.
Figure 3:
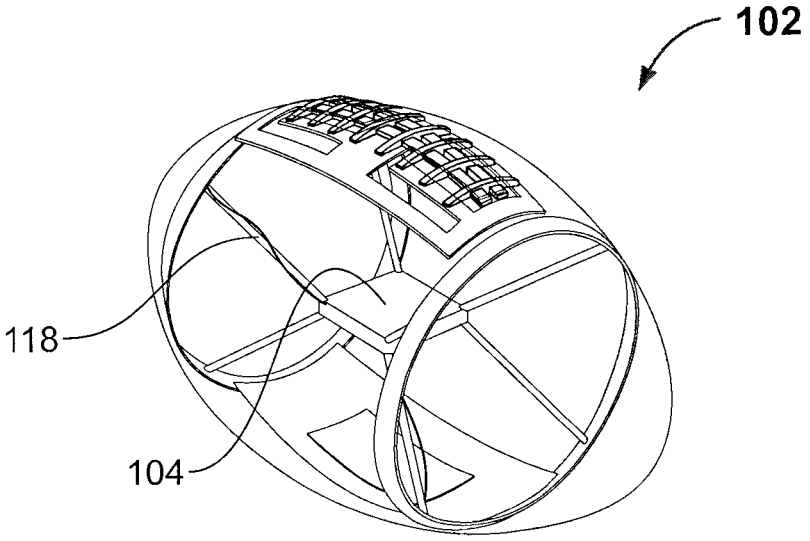
FIG. 3 is a perspective, partially cutaway view of the game ball.
Figure 4:
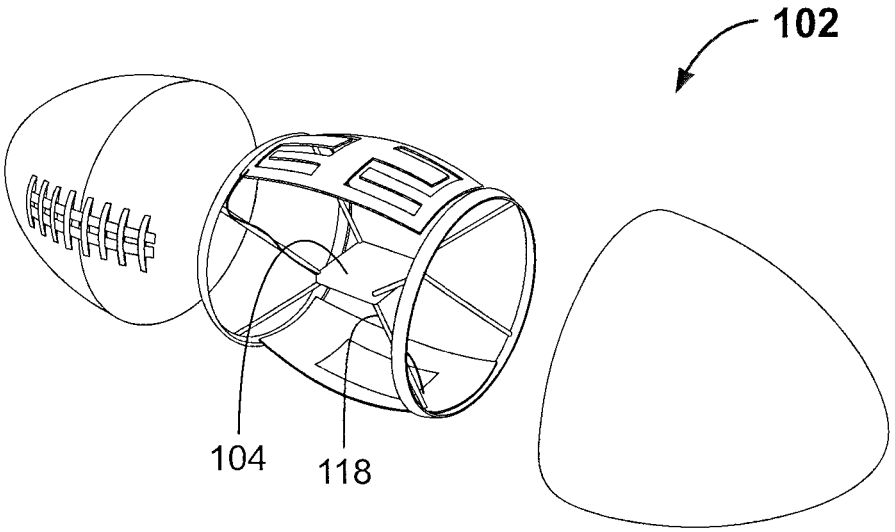
FIG. 4 is an exploded view of the game ball of FIG. 4.
Figure 5:
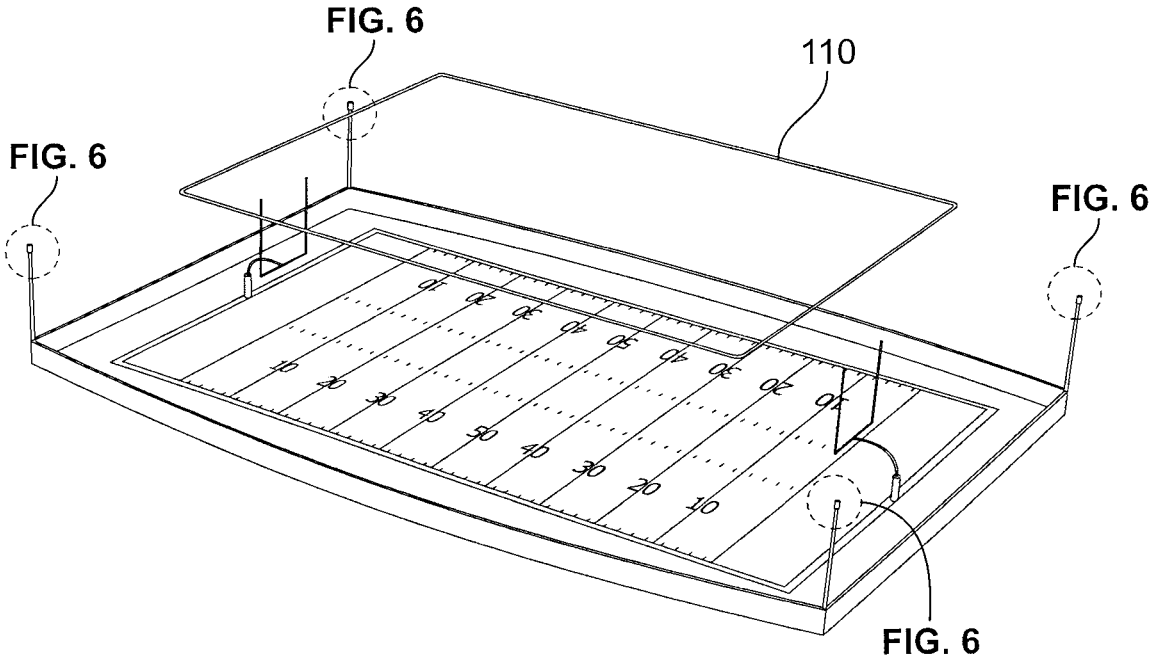
FIG. 5 depicts a playing field equipped with the wireless barrier and transceivers.
Figure 6A:
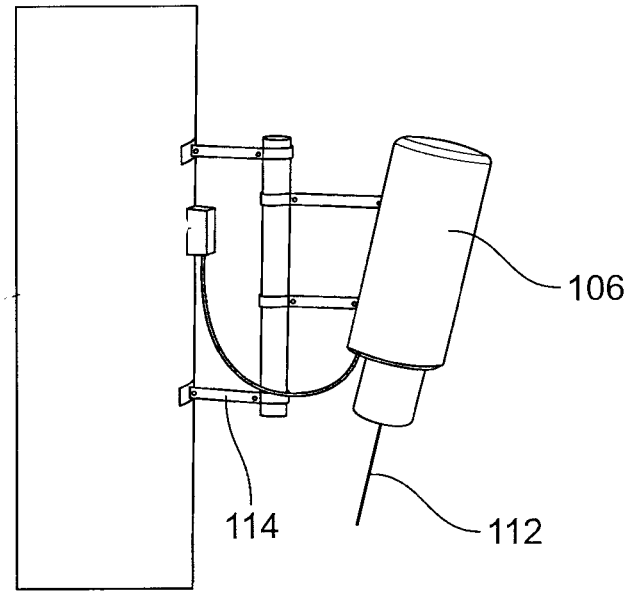
FIG. 6A is an isolated view of an exemplary transceiver.
Figure 6B:
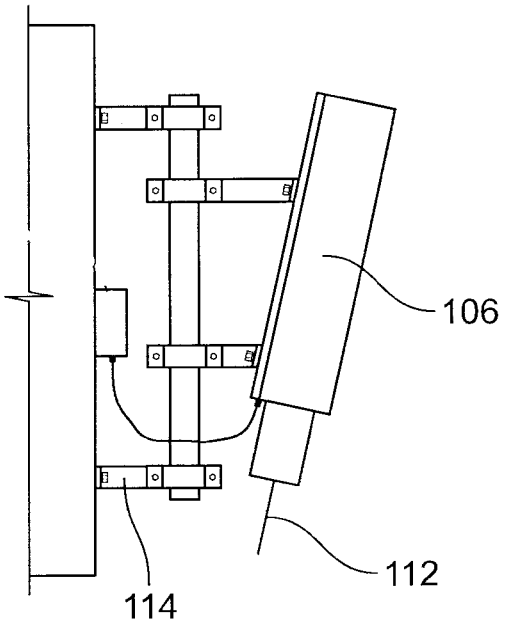
FIG. 6B is a side view of an exemplary transceiver.
Figure 6C:
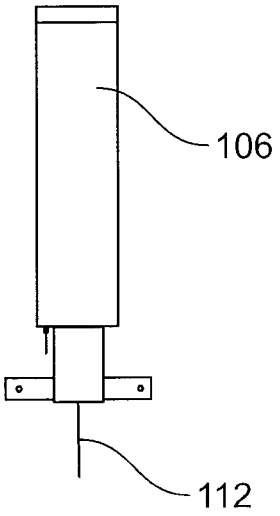
FIG. 6C is a front view of an exemplary transceiver.
Figure 7:
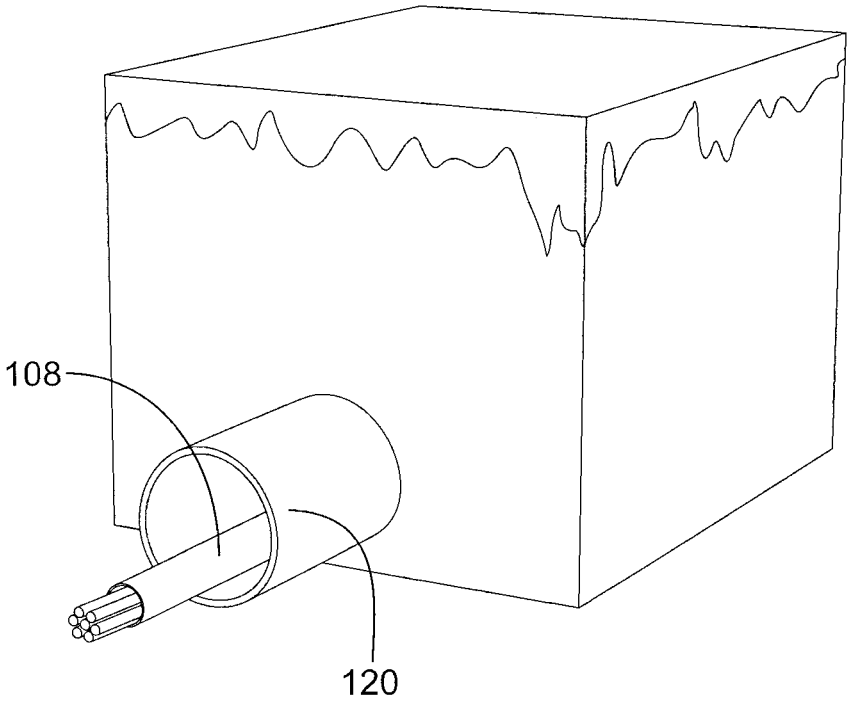
FIG. 7 is an isolated view of the buried cable used to create the wireless barrier.
Figure 8:
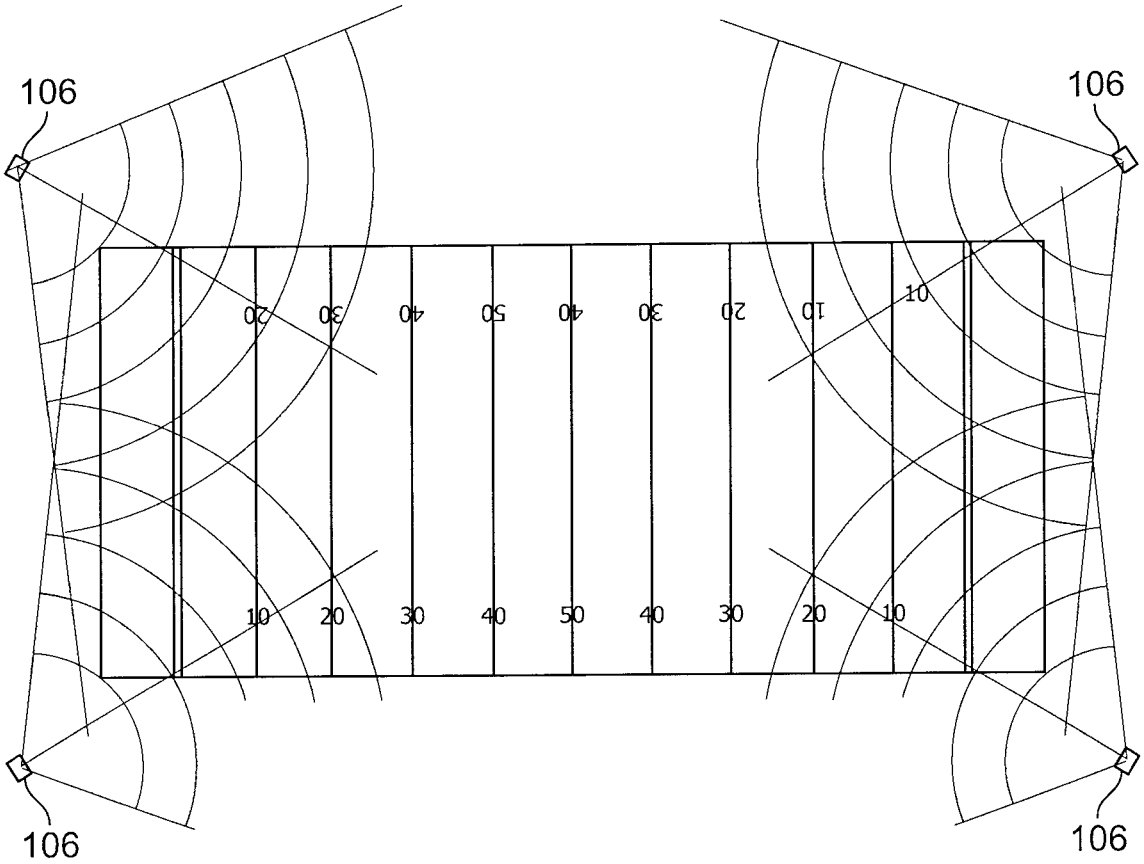
FIG. 8 is a top view of an exemplary playing surface.
Figure 9:
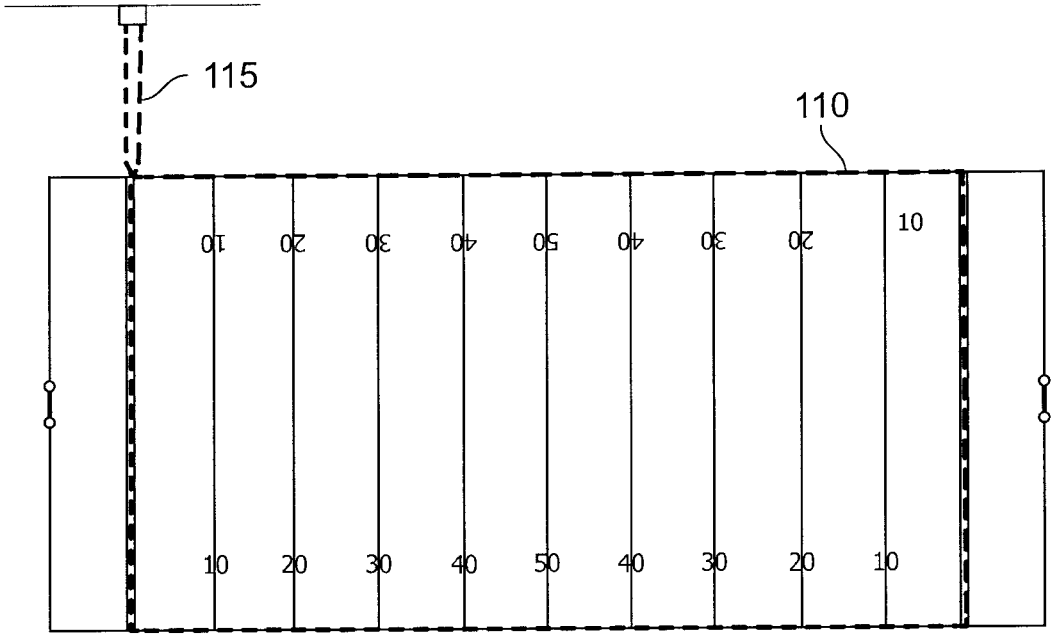
FIG. 9 is a top view of the playing field with the buried cable depicted in phantom.
Figure 10A:
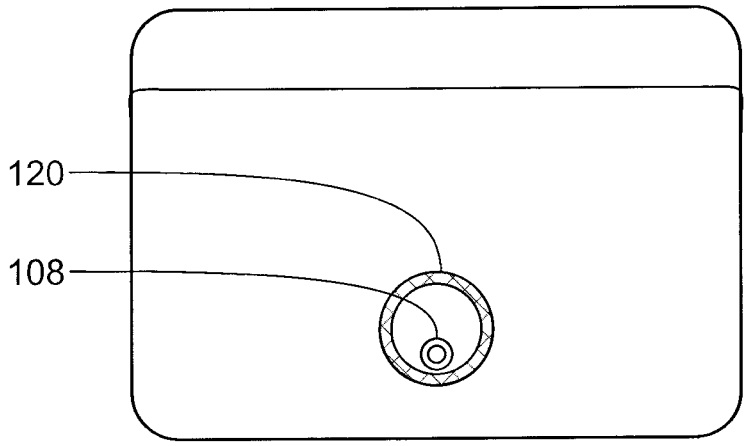
FIG. 10A is a front view of the cable depicted in FIG. 7.
Figure 10B:
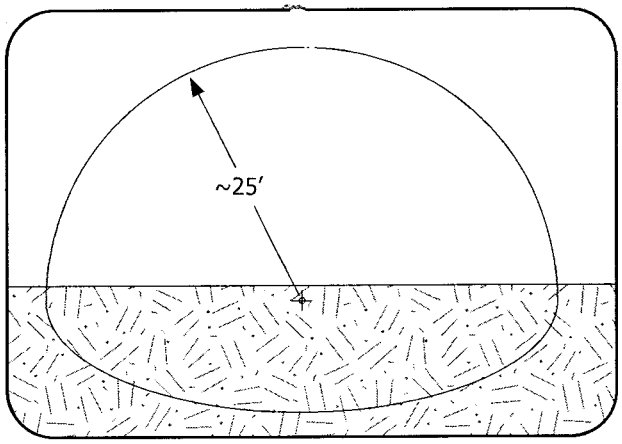
FIG. 10B depicts the field strength of the wireless transmitting barrier.
Figure 11A:
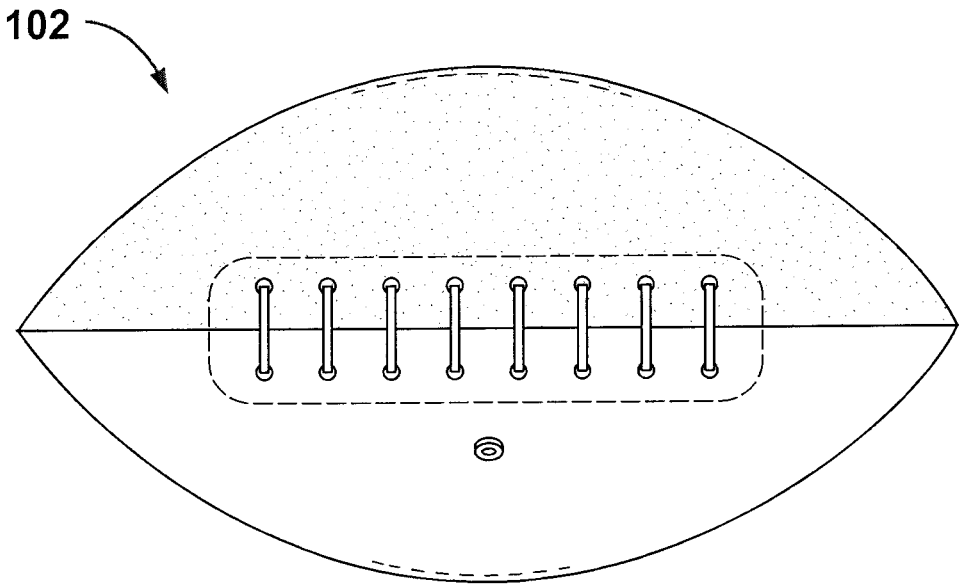
FIG. 11A is a front plan view of the game ball.
Figure 11B:
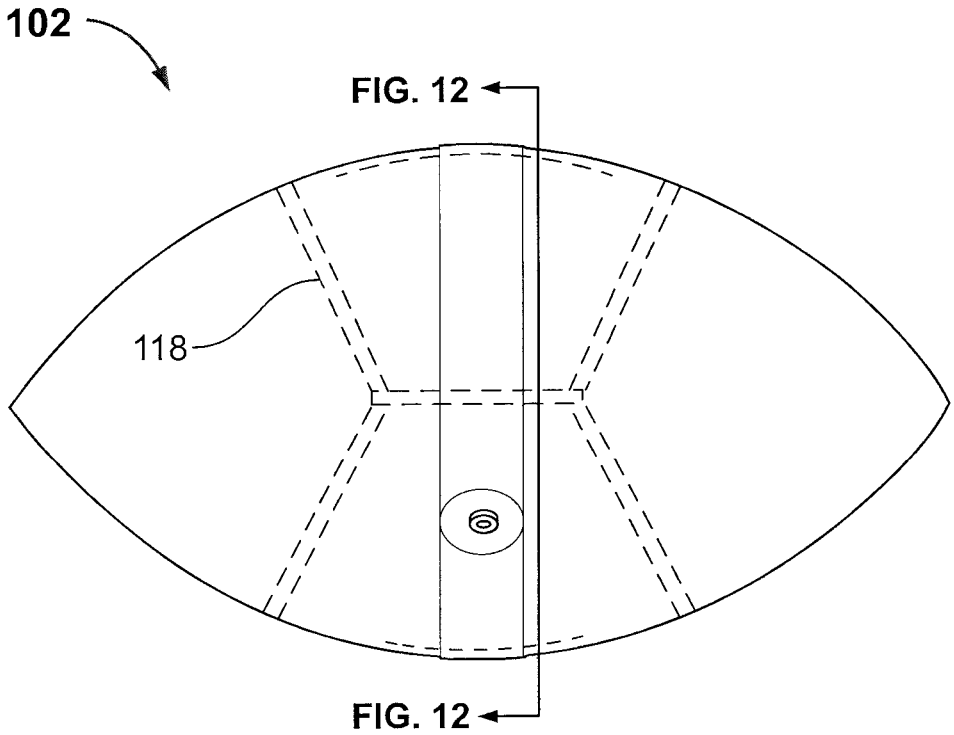
FIG. 11B is a front cutaway view of the game ball.
Figure 12:
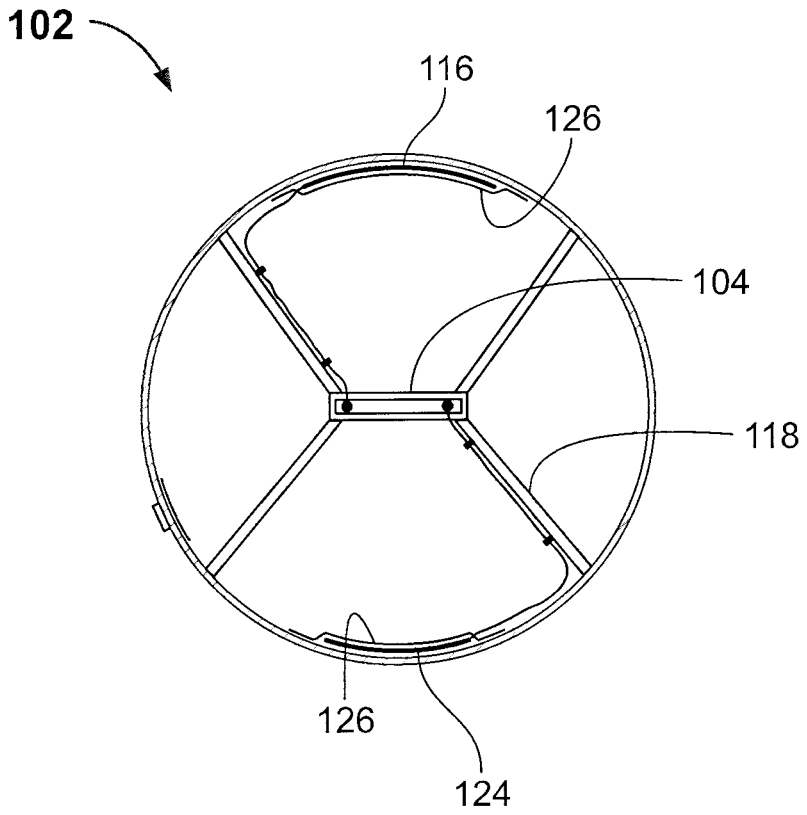
FIG. 12 is a cross-sectional view of the game ball of FIG. 11B.
Figure 13A:
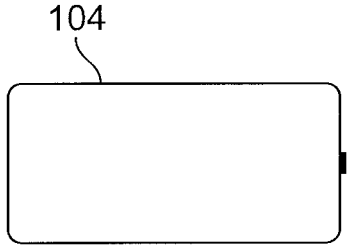
FIG. 13A is a top view of the MEMS module.
Figure 13B:
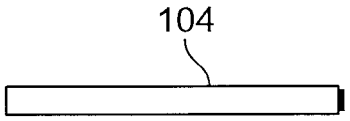
FIG. 13B is a side view of the MEMS module.

The present invention relates to a game ball locating system that allows game officials to readily determine an exact location of the ball when crossing a given playing field boundary or when the ball has stopped moving. In the exemplary embodiment depicted and described herein, the ball is a football 102 though the described technology could be incorporated into any conventional inflatable game ball. The ball 102 includes an outer cover encapsulating an inflatable bladder with a hollow interior for receiving the electronic components described herein. The thickness of the cover is less than that of a standard game ball in order to offset the weight of the internal electronic components. The ball includes a micro-electromechanical system (MEMS) module 104 that communicates with transceivers to determine the ball's location under certain conditions. The MEMS module includes a housing that is centrally suspended within the bladder interior by a plurality of support tubes 118 extending from one side of the bladder to an opposing side.

Received within the housing are numerous electronic components that assist with determining ball position and orientation, including a microcontroller, a gyrometer, an accelerometer, a barometer, and a transceiver. The microcontroller includes software and a network processor with WiFi capabilities to run all network and wireless communication operations described herein. The barometer measures internal ball pressure to allow the system to notify a game official if the ball is deflated below an acceptable level. The barometer has an operating range of 4-20 psi, which encompasses the acceptable pressure ranges of most organized football leagues. The gyrometer and accelerometer are integrated with an optimal-estimation Kalman algorithm to measure the tumble and position of the ball at any given moment in order to adjust the calculated ball position accordingly.

Attached to the inner surface of the bladder is a Q standard wireless charger antenna 124 for recharging the MEMS module battery. The charger antenna communicates with coils positioned within a charging station having multiple cradles that are each configured to hold a game ball.

The system also includes a wireless transmitting barrier 110 that defines a boundary on the playing surface within which a game is played. For example, a football field is defined by a rectangular boundary that includes two opposing sidelines and two opposing goal lines. The wireless barrier 110 includes an RF transmitter 115 connected to a continuous cable 108 immediately beneath the two sidelines and the two goal lines. The cable is preferably contained within a PVC conduit 120 that is buried a few inches below the playing field boundaries. The RF barrier is continuously transmitted at a fixed frequency of approximately 902-928 MHz. A pocket 126 on the bladder interior receives an antenna 116 for receiving the 902-928 MHz signal from the RF transmitting barrier. The MEMS module continuously measures the signal strength of the transmitting barrier until the strength reaches its peak, which indicates the ball is immediately above the playing field boundary.

The system further includes a plurality of time-of-flight (TOF) transceivers 106 that transmit a signal within a range of 2.417-2.450 GHz when receiving a predetermined command from a controlling computer described below. A second antenna adjacent to the first antenna 116 receives the 2.4 GHz signal from the time-of-flight transceivers for transmission to the MEMS module. By measuring the distance between the MEMS module and each transceiver, a computer, described infra, can calculate the ball's exact location. The antenna 116 also allows the MEMS module to communicate with the controlling computer described below. Each transceiver is preferably fixed in an elevated position outside the playing field boundary. For example, each transceiver could be positioned on a wall using a mounting unit 114 at each corner of a stadium to effectively transmit a signal to any location on or near the playing field. Further, each transceiver 106 includes an antenna 112 to accept the activation signal from the controlling computer.

The electronic components are connected to a high-speed controlling computer, which includes software and location algorithms that calculate ball position when crossing the wireless barrier or stopping. The algorithms may, when necessary, add the dimensions of the ball to the calculated position in order for a game official to accurately determine the position of the nose at the time of measurement. The controlling computer engages the TOF transceivers to transmit a discrete signal to the MEMS module in order for the computer algorithms to calculate the ball's location on the playing field. Due to the speed of the transmitted signals, repetitive signals can be transmitted to verify a calculated distance without sacrificing accuracy. The controlling computer then communicates the exact location of the ball to a game official via an audio link and voice synthesizer.

Accordingly, as the game ball approaches the sideline or goal line, the measured signal strength of the transmitting barrier gradually increases until reaching a peak level before decreasing. When the MEMS module determines that peak strength of the wireless barrier has been reached, it requests a location determination. The controlling computer then activates the TOF transmitters to transmit a signal to the MEMS module and the computer calculates the exact position of the ball when the signal strength peaked. Likewise, if the ball stops moving, the MEMS module notifies the computer to instruct the transceivers to transmit location signals to the football. Once a ball location is calculated, the computer can then adjust the measured location to account for ball orientation at the time of measurement. For example, if the ball is horizontal when it stops moving, the resulting measurement will determine where the center of the ball was located, but the nose would be farther up field. In such event, the MEMS module adds the distance from the central, lateral axis of the football to the nose to accurately determine if the nose crossed the goal line, or where the nose was located when the football stopped moving.

The above-described device is not limited to the exact details of construction and enumeration of parts provided herein. Although the present invention has been primarily depicted and described as a system for locating a football, the system could be incorporated into other game balls as well.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A ball locating and positioning system comprising:

a plurality of wireless transceivers positioned around a periphery of a playing surface;

a wireless transmitting barrier positioned to define a boundary on the playing surface within which a game is played;

a ball for playing the game on the playing surface;

a wireless communication module within said ball, said wireless communication module in discrete wireless communication with said transmitters and said barrier, said wireless communication module adapted to transmit a request signal;

a gyrometer and an accelerometer positioned within said ball and in communication with said wireless communication module, said gyrometer and said accelerometer having software for determining an angle and orientation of said ball upon transmission of the request signal;

a controlling computer in communication with said wireless communication module, said controlling computer having software that is adapted to calculate a distance between said communication module and each of said wireless transceivers upon receipt of the request signal from said wireless communication module, to calculate an exact location of said ball on said playing surface according to the distance between said communication module and each of said transceivers, and to calculate an adjusted location on the playing field according to the angle and the orientation of the ball.

2. The ball locating and positioning system according to claim 1 wherein the gyrometer and the accelerometer cause said wireless communication module to generate the request signal when said ball has ceased motion.

3. The ball locating and positioning system according to claim 2 wherein said wireless communication module is capable of measuring a signal strength of said wireless transmitting barrier until said signal strength peaks and subsequently weakens at which time said wireless communication module initiates the request signal.

4. The ball locating and positioning system according to claim 1 wherein said ball is a football having an intermediate portion and two opposing noses.

5. The ball locating and positioning system according to claim 4 wherein the adjusted location is determined by calculating the exact location of one of the noses according to the angle and the orientation of the ball, the exact location of the ball and a predetermined distance between said one of said noses and said wireless communications module.

6. The ball locating and positioning system according to claim 1 wherein said wireless communication module includes a barometer for determining an inflation pressure.

7. The ball locating and positioning system according to claim 1 further comprising a means for receiving the adjusted location of said ball on said playing field and transmitting said adjusted location to a remote game official for placement of the ball on the playing surface.

8. The ball locating and positioning system according to claim 1 wherein said wireless communication module is a micro-electromechanical system.

9. The ball locating and positioning system according to claim 1 wherein said adjusted location of said ball on said playing surface is within one inch of an actual location of said ball.

10. The ball locating and positioning system according to claim 7 wherein said means for receiving the adjusted location of said ball and transmitting said location to a remote game official for placement comprises a computer, an audio link and a voice synthesizer for verbally instructing said official where to place the ball on the playing surface.

* * * * *